US009677030B2

(12) United States Patent
Napolitano

(10) Patent No.: US 9,677,030 B2
(45) Date of Patent: Jun. 13, 2017

(54) AQUEOUS DETERGENT COMPOSITIONS

(71) Applicant: THE SUN PRODUCTS CORPORATION, Wilton, CT (US)

(72) Inventor: Lisa Napolitano, Norwalk, CT (US)

(73) Assignee: HENKEL IP & HOLDING GMBH, Düsseldorf (DE)

( * ) Notice: Subject to any disclaimer, the term of this patent is extended or adjusted under 35 U.S.C. 154(b) by 0 days.

(21) Appl. No.: 14/608,413

(22) Filed: Jan. 29, 2015

(65) Prior Publication Data

US 2015/0210957 A1 Jul. 30, 2015

Related U.S. Application Data

(60) Provisional application No. 61/933,200, filed on Jan. 29, 2014.

(51) Int. Cl.

| | |
|---|---|
| ***C11D 1/83*** | (2006.01) |
| ***C11D 3/22*** | (2006.01) |
| ***C11D 3/50*** | (2006.01) |
| ***C11B 9/00*** | (2006.01) |
| ***C11D 11/00*** | (2006.01) |
| ***C11D 17/00*** | (2006.01) |

(52) U.S. Cl.

CPC ..... *C11D 1/83* (2013.01); *C11B 9/00* (2013.01); *C11D 3/222* (2013.01); *C11D 3/505* (2013.01); *C11D 11/0094* (2013.01); *C11D 17/0026* (2013.01)

(58) Field of Classification Search

CPC ..... C11D 1/83; C11D 3/222; C11D 11/0094; C11D 17/0026

See application file for complete search history.

(56) References Cited

U.S. PATENT DOCUMENTS

| | | | |
|---|---|---|---|
| 3,308,067 | A | 3/1967 | Diehl |
| 3,929,678 | A | 12/1975 | Laughlin et al. |
| 3,976,586 | A | 8/1976 | Chakrabarti |
| 4,663,071 | A | 5/1987 | Bush et al. |
| 5,945,394 | A | 8/1999 | Sajic et al. |
| 5,958,864 | A | 9/1999 | Artiga Gonzalez et al. |
| 6,034,257 | A | 3/2000 | Oftring et al. |
| 6,046,149 | A | 4/2000 | Sorrie et al. |
| 6,056,949 | A | 5/2000 | Menzi et al. |
| 6,458,754 | B1 | 10/2002 | Velazquez et al. |
| 7,776,807 | B2 | 8/2010 | Canto et al. |
| 7,981,855 | B1 | 7/2011 | Palla-Venkata et al. |
| 2008/0108541 | A1 | 5/2008 | Swazey |
| 2008/0146485 | A1 | 6/2008 | Swazey |
| 2011/0224127 | A1 | 9/2011 | Blyth et al. |

FOREIGN PATENT DOCUMENTS

| | | | | |
|---|---|---|---|---|
| EP | 0 066 915 | A2 | 12/1982 | |
| EP | 0 193 360 | A2 | 9/1986 | |
| EP | 0 726 356 | A1 | 8/1996 | |
| WO | WO 2009/101545 | A1 | 8/2009 | |
| WO | WO 2012/052306 | A1 | 4/2012 | |
| WO | WO 2012/065924 | A1 | 5/2012 | |
| WO | WO 2012/065925 | A1 | 5/2012 | |
| WO | WO 2013/160023 | A1 | 10/2013 | |
| WO | WO 2014/017913 | * | 1/2014 | ..... C08B 37/14 |
| WO | WO 2014/017913 | A1 | 1/2014 | |
| WO | WO 2014/142651 | A1 | 9/2014 | |

OTHER PUBLICATIONS

International Search Report for International Patent Application No. PCT/US2015/011425, European Patent Office, Rijswijk, Netherlands, mailed Apr. 16, 2015, 10 pages.

* cited by examiner

*Primary Examiner* — Brian P Mruk

(74) *Attorney, Agent, or Firm* — Sterne, Kessler, Goldstein and Fox P.L.L.C.

(57) ABSTRACT

The present invention is directed to a liquid detergent composition, comprising from about 5 wt % to about 45 wt % of a surfactant, about 0.01 wt % to about 1 wt % of an external structuring agent which is a parenchymal cellulose material, and about 0.1 wt % to about 10 wt % of a builder component. The present invention is also directed to methods of preparing the liquid detergent compositions. The present invention is directed to a fragrance composition, comprising about 10 to about 75 wt % of a fragrance component and about 0.01 wt % to about 1 wt % of an external structuring agent.

14 Claims, No Drawings

AQUEOUS DETERGENT COMPOSITIONS

This application claims priority to U.S. Provisional Application Ser. No. 61/933,200, filed on Jan. 29, 2014.

This invention relates to structured aqueous detergent compositions comprising a surfactant, an external structuring agent, and a builder.

BACKGROUND OF THE INVENTION

Detergent compositions typically comprise one or more surfactants to provide cleaning. Such detergent compositions are often thickened to impart the desired rheology for their particular applications. A structurant may be used (either internal or external). This can impart higher levels of storage stability to the composition and it may provide it with enough structure to be able to suspend included solids or gasses, such as fragrance capsules or air bubbles.

Liquid detergent products present a challenge to formulators when it comes to structuring the compositions. One particular purpose of providing distinctive structure is to provide specific flow behavior. Specific types of applications often require specific flow behavior. Another common purpose of providing structure is to enable suspending solid particles in the detergent matrix, or dispersing liquids which are immiscible in the detergent matrix. In non-structured liquid detergent or personal care products, the presence of such ingredients generally leads to sedimentation or phase separation and therefore renders such detergents unacceptable from a consumer's viewpoint.

Hence, two structuring properties are typically desired in liquid detergent and personal care products: shear thinning capabilities and bead and/or particle suspension capabilities. The capability to suspend particles in principle is characterized by the yield stress value. High zero-shear viscosity values may also be indicative of particle suspension capability. Shear thinning capabilities are typically characterized by the pouring viscosity and the ratio of the pouring viscosity and low-stress viscosity values. As will be understood, the ability of a certain structuring agent to provide shear thinning capabilities alone is insufficient to determine whether the liquid product is capable of suspending bead particles with sufficient stability and vice versa. Structuring benefits are desired at as low a level of external structurant as possible for cost and formulation concerns. For example, excessive amounts of external structuring agent may provide the particle suspension capability but result in the liquid composition becoming overly viscous and non-pourable.

It is also relevant that a structuring agent can be applied in highly concentrated liquid detergent compositions, which have low dosage volumes with high cleaning performance. Many attempts have been and still are made to produce concentrated products containing less than 50% water and high active ingredient levels. These low dosage concentrated products are in high demand since they conserve resources and can be sold in small packages. The stabilization of liquid detergent products containing very high levels of surfactants and other active ingredients and lower levels of water has proven to be particularly challenging. A further relevant trend seen in the field of liquid detergent products is the increasing demand for bio-based products, to reduce the environmental impact of the products.

Conventional approaches for providing distinctive structure to liquid detergent and personal care products include the addition of specific structuring agents, including both internal and external structuring agents. Examples of known internal structuring agents include: surfactants and electrolytes. External structuring agents include polymers or gums, many of which are known to swell or expand when hydrated to form random dispersion of independent microgel particles. Examples include acrylate polymers, structuring gums (e.g., xanthan gum), starch, agar, hydroxyl alkyl cellulose etc. Although gums have been used to provide structuring benefits, the gums are pH dependent, i.e. failing at pH above 10. The stability of gums is also unsatisfactory at high electrolyte concentrations. Further, certain gums have been found to be susceptible to degradation in the presence of detersive enzymes. Thus, there remains a need for other external structuring agents less susceptible to these and other known problems. When large particles are suspended (e.g., polyethylene particles, guar beads), levels of polymer used is typically 1% or more.

It has previously been shown that when certain fibrous polymers (e,g., micro fibrous cellulose with large aspect ratios) are used as structurants, these may provide efficient suspending properties even at polymer levels as low as 0.1% (see e.g. U.S. Pat. No. 7,776,807, US2008/0108541 and US2008/0146485). The fibrous polymers are believed to form spider network like structures which efficiently trap the particles inside the network and thereby impart good suspending properties. The polymers are said to provide excel lent rheological properties and are said to be salt tolerant if salt is used in the formulation. Another material reported to provide structuring benefits is bacterial cellulose. Bacterial cellulose is typically cultured using a bacterial strain of *Acetobacter aceti* var. *xylinum* and dried using spray drying or freeze drying techniques. Attempts to manufacture and prepare the dried bacterial cellulose compositions which can be rehydrated and activated into a particulate cellulose material for use in end products are known.

WO2009101545 describes an external structuring agent for use in liquid detergent products that comprises a bacterial cellulose network. This external structuring agent is said to provide both shear thinning capabilities and particle suspension capabilities. According to WO2012/065924 and WO2012/065925 external structuring agents based on micro fibrous cellulose, such as in particular bacterial cellulose, have a zero or near zero stress-shear rate profile (i.e., zero stress-shear rate slope when plotting shear rate versus stress), resulting in flow instability and shear handing. According to WO2012/065924 these flow instability problems can be reduced or eliminated by the addition of low molecular weight water soluble polymers to the compositions comprising microfibrous (bacterial) cellulose. WO2012/065925 teaches to overcome the flow instability problems by the addition of citrus fiber to the compositions comprising microfibrous (bacterial) cellulose as an external structuring agent. The citrus fiber according to WO2012/065925 is obtained by extraction of peels and vesicles in the pulp of citrus fruit that remains after removal of the sugars to leave mainly insoluble hemicellulose.

Apart from the flow instability problems bacterial cellulose also has the obvious disadvantage that it is a relatively expensive material. WO2012/052306 concerns laundry detergent products containing enzymes with cellulase activity. WO2012/052306 employs citrus fiber as an external structurant because it can be employed at much higher levels than bacterial MFC due to its lower cost and lower efficacy as a structurant, which is said to confer the advantage of greater resistance to destabilisation under the influence of cellulase. At a level of 0.12% the citrus fiber material did not provide sufficient suspension capability. WO2012/052306 furthermore does not address the issue of flow instability and shear banding. To date, no liquid detergent or personal care products containing any of these types of cellulose materials as external structuring agent have become available commercially. This may be cost-related and/or the consequence of certain shortcomings of these materials in practice, e.g. in relation to performance, stability, etc.

There still remains a need for more stable liquid detergent compositions having shear thinning capabilities and sufficient stability and particle suspension capabilities while avoiding one or more of the above mentioned problems encountered With prior art formulations.

BRIEF SUMMARY OF THE INVENTION

In one embodiment, the invention is a liquid detergent composition, comprising:

(a) an aqueous medium;
(b) about 5 wt % to about 45 wt % of a surfactant system;
(c) about 0.1 wt % to about 10 wt % of a builder component;
(d) about 0.01 wt % to about 1 wt % of an external structuring agent, comprising particulate cellulose material containing, by dry weight, at least 60% cellulose, 0.5-10% pectin and 1-15% hemicellulose, and has a volume-weighted. median particle dimension within the range of 25-75 μm, as measured by laser light diffractometry.

In one embodiment, the particulate cellulose material has a volume-weighted median particle dimension within the range of 35-65 μm, as measured by laser light diffractometry.

In one embodiment, the surfactant system is an anionic surfactant, a nonionic surfactant, a cationic surfactant, an ampholytic surfactant, a zwitterionic surfactant, or mixtures thereof.

In another embodiment, the liquid detergent composition further comprises a builder component selected from the group consisting of organic acids, alkali metal hydroxides, amines, and mixtures thereof.

In another embodiment, the liquid detergent composition further comprises additional components, selected from the group consisting of a chelator, a defoamer, an enzyme, a fragrance component, and mixtures thereof.

In one embodiment, the invention is a method for preparing a liquid detergent composition, comprising:

(a) dispersing from about 0.01-1 wt % of a structuring agent in water, wherein the structuring agent comprises particulate cellulose material containing, by dry weight, at least 60% cellulose, 0.5-10% pectin and 1-15% hemicellulose, and has a volume-weighted median particle dimension within the range of 25-75 μm, as measured by laser light diffractometry;
(b) shearing the dispersion of the structuring agent to form a uniform aqueous suspension of the structuring agent;
(c) mixing the aqueous suspension of the structuring agent with a surfactant system; and
(d) shearing the aqueous suspension of step (c);
(e) optionally mixing in additional components;

to obtain the liquid detergent composition.

In one embodiment, the particulate cellulose material has a volume-weighted median particle dimension within the range of 35-65 μm, as measured by laser light diffractometry.

In another embodiment, the invention is a fragrance composition, comprising about 10-75 wt % of an encapsulated fragrance component and from about 0.01-1 wt % of an external structuring agent, comprising particulate cellulose material containing, by dry weight, at least 60% cellulose, 0.5-10% pectin and 1-15% hemicellulose, and has a volume-weighted median particle dimension within the range of 25-75 μm, as measured by laser light diffractometry.

DETAILED DESCRIPTION OF THE INVENTION

The following description provides specific details, such as materials and dimensions, to provide a thorough understanding of the present invention. The skilled artisan, however, will appreciate that the present invention can be practiced without employing these specific details. Indeed, the present invention can be practiced in conjunction with processing, manufacturing or fabricating techniques conventionally used in the detergent industry. Moreover, the processes below describe only steps, rather than a complete process flow, for manufacturing the compositions and detergents containing the compositions according to the present invention.

The term "about" as used herein, includes the recited number ±10%. Thus, "about ten" means 9 to 11.

The wt % amounts in the specification refer to the amounts of active ingredient in the final composition.

Liquid Detergent Compositions

In one embodiment, the invention is a liquid detergent composition comprising:

(a) an aqueous medium;
(b) about 5 wt % to about 45 wt % of a surfactant system;
(c) about 0.1 wt % to about 10 wt % of a builder component;
(d) about 0.01 wt % to about 1 wt % of an external structuring agent, comprising particulate cellulose material containing, by dry weight, at least 60% cellulose, 0.5-10% pectin and 1-15% hemicellulose, and has a volume-weighted median particle dimension within the range of 25-75 μm, as measured by laser light diffractometry.

In one embodiment, the particulate cellulose material has a volume-weighted median particle dimension within the range of 35-65 μm as measured by laser light diffractometry.

In another embodiment, the liquid detergent composition comprises about 0.01 wt % to about 0.5 wt % of the external structuring agent. In one embodiment, the liquid detergent composition comprises about 0.01 wt % to about 0.3 wt %, about 0.03 wt % to about 0.3 wt %, 0.05 wt % to about 0.3 wt %, 0.01 wt % to about 0.1 wt %, 0.08 wt % to about 0.5 wt %, about 0.01 wt % to about 0.5 wt %, about 0.05 wt % to about 0.5 wt %, about 0.08 wt % to about 0.5 wt %, of the external structuring agent. In another embodiment, the liquid detergent composition comprises about 0.01 wt %, 0.02 wt %, 0.03 wt %, 0.04 wt %, 0.05 wt %, 0.06 wt %, 0.07 wt %, 0.08 wt %, 0.09 wt %, 0.1 wt %, 0.2 wt %, 0.3 wt %, 0.4 wt %, 0.5 wt %, 0.6 wt %, 0.7 wt %, 0.8 wt %, 0.9 wt %, or 1 wt % of the external structuring agent.

In one embodiment, the surfactant system is an anionic surfactant, a nonionic surfactant, a cationic surfactant, an ampholytic surfactant, a zwitterionic surfactant, or mixtures thereof. In another embodiment, the surfactant system is an anionic surfactant, a nonionic surfactant, or mixtures thereof.

In one embodiment, the liquid detergent composition comprises about 5 wt % to about 45 wt % of the surfactant system. In another embodiment, the liquid detergent composition comprises about 1 wt % to about 10 wt %, about 1 wt % to about 20 wt %, about 1 wt % to about 30 wt %, about 1 wt % to about 40 wt %, about 6 wt % to about 40 wt %, about 6 wt % to about 10 wt %, about 10 wt % to about 20 wt %, about 10 wt % to about 30 wt %, about 10 wt % to about 40 wt %, about 20 wt % to about 30 wt %, about 20 wt % to about 40 wt %, or about 30 wt % to about 40 wt %, about 20 wt % to about 45 wt %, about 30 wt % to about 45 wt %, about 40 wt % to about 45 wt %, of the surfactant system. In another embodiment, the liquid detergent composition comprises about 5 wt %, 10 wt %, 15 wt %, 20 wt %, 25 wt %, 30 wt %, 35 wt %, 40 wt %, 45 wt %, of the surfactant system.

In another embodiment, the builder component is selected from the group consisting of organic acids, alkali metal hydroxides, amines, and mixtures thereof. In yet another embodiment the builder component is selected from the group consisting of citric acid, sodium hydroxide, sodium carbonate, sodium bicarbonate, calcium chloride, triethanolamine, monoethanolamine, and mixtures thereof, in an amount from about 1% to about 8%. In one embodiment, the builder component is present in an amount of about 1 wt %, 2 wt %, 3 wt %, 4 wt %, 5 wt %, 6 wt %, 7 wt %, 8 wt %, 9 wt %, or 10 wt %.

In one embodiment, the liquid detergent composition further comprises a chelator. In another embodiment, the chelator is a polycarboxylic acid. In another embodiment, the polycarboxylic acid is ethylenediaminetetraacetic acid, succinic acid, iminodisuccinic acid, salts thereof, or mixtures thereof.

In one embodiment, the liquid detergent composition further comprises at least one additional component selected from the group consisting of a defoamer, an enzyme, a color component, a fragrance component, and mixtures thereof.

In one embodiment, the liquid detergent composition has an encapsulated fragrance component.

Methods of Making Liquid Detergent Compositions

In one embodiment, the invention is a method for preparing a liquid detergent composition, comprising:

(a) dispersing from about 0.01 wt % to about 1 wt % of a structuring agent in water to form a dispersion;
(b) homogenizing the dispersion to form a substantially uniform aqueous suspension;
(c) mixing the substantially uniform aqueous suspension with about 5 to about 45 wt % of a surfactant to form a second aqueous suspension; and
(d) shearing the second aqueous suspension of step (c);
(e) mixing about 0.1 wt % to about 10 wt % of a builder component in the second aqueous suspension; and
(f) optionally mixing in additional components;

to obtain a liquid detergent composition.

In one embodiment, the particulate cellulose material has a volume-weighted median particle dimension within the range of 35-65 μm, as measured by laser light diffractometry.

In one embodiment, about 0.01 wt % to about 0.5 wt % of the external structuring agent is dispersed in water to form a dispersion. In one embodiment, about 0.01 wt % to about 0.3 wt %, about 0.03 wt % to about 0.3 wt %, 0.05 wt % to about 0.3 wt %, 0.01 wt % to about 0.1 wt %, 0.08 wt % to about 0.5 wt %, about 0.01 wt % to about 0.5 wt %, about 0.05 wt % to about 0.5 wt %, about 0.08 wt % to about 0.5 wt %, of the external structuring agent is dispersed in water to form a dispersion. In another embodiment, about 0.01 wt %, 0.02 wt %, 0.03 wt %, 0.04 wt %, 0.05 wt %, 0.06 wt %, 0.07 wt %, 0.08 wt %, 0.09 wt %, 0.1 wt %, 0.2 wt %, 0.3 wt %, 0.4 wt %, 0.5 wt %, 0.6 wt %, 0.7 wt %, 0.8 wt %, 0.9 wt %, or 1 wt % of the external structuring agent is dispersed in water to form a dispersion.

In one embodiment, the external structuring agent is provided as an aqueous dispersion, a paste, a moist powder, or a slurry. In another embodiment, the external structuring agent is provided as a solid powder.

In one embodiment, the substantially uniform aqueous suspension of the structuring agent is mixed with a surfactant system, wherein the surfactant system is an anionic surfactant, a nonionic surfactant, a cationic surfactant, an ampholytic surfactant, a zwitterionic surfactant, or mixtures thereof. In another embodiment, the surfactant system is an anionic surfactant, a nonionic surfactant, or mixtures thereof. In another embodiment, the substantially uniform aqueous suspension of the structuring agent is mixed with about 5 wt % to about 45 wt % of the surfactant system. In another embodiment, the substantially uniform aqueous suspension of the structuring agent is mixed with about 1 wt % to about 10 wt %, about 1 wt % to about 20 wt %, about 1 wt % to about 30 wt %, about 1 wt % to about 40 wt %, about 6 wt % to about 40 wt %, about 6 wt % to about 10 wt %, about 10 wt % to about 20 wt %, 10 wt % to about 30 wt %, 10 wt % to about 40 wt %, 20 wt % to about 30 wt %, 20 wt % to about 40 wt %, or 30 wt % to about 40 wt % of the surfactant system. In another embodiment, the substantially uniform aqueous suspension of the structuring agent is mixed with about 5 wt %, 10 wt %, 15 wt %, 20 wt %, 25 wt %, 30 wt %, 35 wt %, 40 wt % of the surfactant system.

In another embodiment, the second aqueous suspension is mixed with a builder component selected from the group consisting of organic acids, alkali metal hydroxides, amines, and mixtures thereof. In yet another embodiment the builder component is selected from the group consisting of citric acid, sodium hydroxide, triethanolamine, monoethanolamine, and mixtures thereof, in an amount from about 1% to about 8%. In one embodiment, the second aqueous suspension is mixed with a builder component it an amount of about 1 wt %, 2 wt %, 3 wt %, 4 wt %, 5 wt %, 6 wt %, 7 wt %, 8 wt %, 9 wt %, or 10 wt %.

In one embodiment, the aqueous suspension of step (e) is mixed with at least one additional component selected from the group consisting of a chelator, a defoamer, an enzyme, a color component, a fragrance component, and mixtures thereof. In another embodiment, the chelator is a polycarboxylic acid. In another embodiment, the polycarboxylic acid is ethylenediaminetetraacetie acid, succinic acid, iminodisuccinic acid, salts thereof, or mixtures thereof. In one embodiment, the fragrance component is encapsulated.

In some embodiments, the pouring viscosity of the aqueous detergent compositions, as defined herein, is measured at a shear rate of 20 $s^{-1}$. In one embodiment of the invention, a pouring viscosity of the aqueous detergent compositions is attained ranging from about 50 to about 1000 mPa·s, or from 100 to 1000 mPa·s, about 200 to about 800 mPa·s, about 200 to about 600 mPa·s, about 400 to about 800 mPa·s, or about 400 to about 600 mPa·s.

Fragrance Compositions

In one embodiment, the invention is a fragrance composition, comprising:

(a) an aqueous medium;
(b) about 10 to about 75 wt % of a fragrance component; and
(c) about 0.01 to about 1 wt % of an external structuring agent, comprising particulate cellulose material containing, by dry weight, at least 60% cellulose, 0.5-10% pectin and 1-15% hemicellulose, and has a volume-weighted median particle dimension within the range of 25-75 μm, as measured by laser light diffractometry.

In one embodiment, the particulate cellulose material has a volume-weighted median particle dimension within the range of 35-65 μm, as measured by laser light diffractometry.

In another embodiment, fragrance composition comprises about 0.01 wt % to about 0.5 wt % of the external structuring agent. In one embodiment, the liquid detergent composition comprises about 0.01 wt % to about 0.3 wt %, about 0.03 wt % to about 0.3 wt %, 0.05 wt % to about 0.3 wt %, 0.01 wt % to about 0.1 wt %, 0.08 wt % to about 0.5 wt %, about 0.01 wt % to about 0.5 wt %, about 0.05 wt % to about 0.5 wt %, about 0.08 wt % to about 0.5 wt %, of the external structuring agent. In another embodiment, the fragrance composition comprises about 0.01 wt %, 0.02 wt %, 0.03 wt %, 0.04 wt %, 0.05 wt %, 0.06 wt %, 0.07 wt %, 0.08 wt %, 0.09 wt %, 0.1 wt %, 0.2 wt %, 0.3 wt %, 0.4 wt %, 0.5 wt %, 0.6 wt %, 0.7 wt %, 0.8 wt %, 0.9 wt %, or 1 wt % of the external structuring agent.

In one embodiment, the external structuring agent is provided as an aqueous dispersion, a paste, a moist powder, or a slurry. In another embodiment, the external structuring agent is provided as a solid powder.

In another embodiment, the fragrance composition comprises about 10-20 wt %, 20-30 wt %, 30-40 wt %, 40-50 wt %, 50-60 wt %, or 60-70 wt % of the fragrance component. In another embodiment, the fragrance composition comprises about 10 wt %, 15 wt %, 20 wt %, 25 wt %, 30 wt %, 35 wt %, 40 wt %, 45 wt %, 50 wt %, 55 wt %, 60 wt %, 65 wt %, 70 wt %, or 75 wt % of the encapsulated fragrance component.

In one embodiment, the fragrance component is is in the form of unencapsulated fragrance particles. In another embodiment, at least some of the fragrance can be encapsulated in a microcapsule. In one embodiment, all of the fragrance can be encapsulated in microcapsules. The microcapsules can be water-soluble or water-insoluble.

In one embodiment of the invention, a pouring viscosity of the fragrance compositions is attained ranging from about 50 to about 1000 mPa·s, or from 100 to 1000 mPa·s, about 200 to about 800 mPa·s, about 200 to about 600 mPa·s, about 400 to about 800 mPa·s, or about 400 to about 600 mPa·s.

Surfactants

In one embodiment, the surfactant system in the compositions of the present invention is an anionic surfactant, a nonionic surfactant, a cationic surfactant, an ampholytic surfactant, a zwitterionic surfactant, or mixtures thereof.

Anionic Surfactants

Suitable anionic surfactants includes those surfactants that contain a long chain hydrocarbon hydrophobic group in their molecular structure and a hydrophilic group, i.e., water solubilizing group including salts such as carboxylate, sulfonate, sulfate or phosphate groups. Suitable anionic surfactant salts include sodium, potassium, calcium, magnesium, barium, iron, ammonium and amine salts. Other suitable secondary anionic surfactants include the alkali metal, ammonium and alkanol ammonium salts of organic sulfuric reaction products having in their molecular structure an alkyl, or alkaryl group containing from 8 to 22 carbon atoms and a sulfonic or sulfuric acid ester group. Examples of such anionic surfactants include water soluble salts of alkyl benzene sulfonates having between 8 and 22 carbon atoms in the alkyl group, alkyl ether sulfates having between 8 and 22 carbon atoms in the alkyl group. In one embodiment, the anionic surfactant comprises an alkali metal salt of $C_{10-16}$ alkyl benzene sulfonic acids, or $C_{11-14}$ alkyl benzene sulfonic acids. In one embodiment, the alkyl group is linear and such linear alkyl benzene sulfonates are known as "LAS." Alkyl benzene sulfonates, and particularly LAS, are well known in the art. Other suitable anionic surfactants include: sodium and potassium linear straight chain alkylbenzene sulfonates in which the average number of carbon atoms in the alkyl group is from 11 to 14. Sodium $C_{11}$-$C_{14}$ e.g., $C_{12}$, LAS is one suitable anionic surfactant for use herein.

Other anionic surfactants include polyethoxylated alcohol sulfates, such as those sold under the trade name CALFOAM® 303 (Pilot Chemical Company, California), Such materials, also known as alkyl ether sulfates or alkyl polyethoxylate sulfates, are those which correspond to the formula: R'—O—$(C_2H_4O)$n-$SO_3M$; wherein R' is a $C_8$-$C_{20}$ alkyl group, n is from 1 to 20, and M is a salt-forming cation; alternatively, R' is $C_{10}$-$C_{18}$ alkyl, n is front 1 to 15, and M is sodium, potassium, ammonium, alkylammonium, or alkanolammonium, in another embodiment, R' is a $C_{12}$-$C_{16}$, n is from 1 to 6 and M is sodium. The alkyl ether sulfates will generally be used in the form of mixtures comprising varying R' chain lengths and varying degrees of ethoxylation. Frequently such mixtures will inevitably also contain some unethoxylated alkyl sulfate materials, i.e., surfactants of the above ethoxylated alkyl sulfate formula wherein n=0. Unethoxylated alkyl sulfates may also be added separately to the compositions of this invention and used as or in any anionic surfactant component which may be present. Suitable unalkoxyxylated, e.g., unethoxylated, alkyl ether sulfate surfactants are those produced by the sulfation of higher $C_8$-$C_{20}$ fatty alcohols. Conventional primary alkyl sulfate surfactants have the general formula of: $ROSO_3M^+$, wherein R is typically a linear $C_8$-$C_{20}$ hydrocarbyl group, which may be straight chain or branched chain, and M is a watersolubilizing cation; alternatively R is a $C_{10}$-$C_{15}$ alkyl, and M is alkali metal, In one embodiment, R is $C_{12}$-$C_{14}$ and M is sodium. Examples of other anionic surfactants are disclosed in U.S. Pat. No. 3,976,586, the disclosure of which is incorporated by reference herein. In another embodiment, the composition is substantially free of additional (secondary) anionic surfactants.

In one embodiment, the anionic surfactant is at least one α-sulfofatty acid ester. Such a sulfofatty acid is typically formed by esterifying a carboxylic acid with an alkanol and then sulfonating the α-position of the resulting ester. The α-sulfofatty acid ester is typically of the following formula (I):

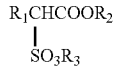

(I)

wherein $R_1$ is a linear or branched alkane, $R_2$ is a linear or branched alkane, and $R_3$ is hydrogen, a halogen, a monovalent or di-valent cation, or an unsubstituted or substituted ammonium cation. $R_1$ can be a $C_4$ to $C_{24}$ alkane, including a $C_{10}$, $C_{12}$, $C_{14}$, $C_{16}$ and/or $C_{18}$ alkane. $R_2$ can be a $C_1$ to $C_8$ alkane, including a methyl group. $R_3$ is typically a monovalent or di-valent cation, such as a cation that forms a water soluble salt with the α-sulfofatty acid ester (e.g., an alkali metal salt such as sodium, potassium or lithium). The α-sulfofatty acid ester of formula (I) can be a methyl ester sulfonate, such as a $C_{16}$ methyl ester sulfonate, a $C_{18}$ methyl ester sulfonate, or a mixture thereof. In another embodiment, the α-sulfofatty acid ester of formula (I) can be a methyl ester sulfonate, such as a mixture of $C_{12}$-$C_{18}$ methyl ester sulfonates.

More typically, the α-sulfofatty acid ester is a salt, which is generally of the following formula (II):

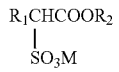

(II)

wherein $R_1$ and $R_2$ are alkanes and M is a monovalent metal. For example, $R_1$ can be an alkane containing 4 to 24 carbon atoms, and is typically a $C_8$, $C_{10}$, $C_{12}$, $C_{14}$, $C_{16}$ and/or $C_{18}$ alkane. $R_2$ is typically an alkane containing 1 to 8 carbon atoms, and more typically a methyl group. M is typically an alkali metal, such as sodium or potassium. The α-sulfofatty acid ester of formula (II) can be a sodium methyl ester sulfonate, such as a sodium $C_8$-$C_{18}$ methyl ester sulfonate.

In one embodiment, the anionic surfactant is at least one α-sulfofatty acid ester. For example, the α-sulfofatty acid ester can be as $C_{10}$, $C_{12}$, $C_{14}$, $C_{16}$ or $C_{18}$ α-sulfofatty acid ester. In another embodiment, the α-sulfofatty acid ester comprises a mixture of sulfofatty acids. For example, the composition can comprise a mixture of α-sulfofatty acid esters, such as $C_{10}$, $C_{12}$, $C_{14}$, $C_{16}$ and $C_{18}$ sulfofatty acids. The proportions of different chain lengths in the mixture are selected according to the properties of the α-sulfofatty acid esters. For example, $C_{16}$ and $C_{18}$ sulfofatty acids (e.g., from tallow and/or palm stearin MES) generally provide better surface active agent properties, but are less soluble in aqueous solutions. $C_{10}$, $C_{12}$ and $C_{14}$ α-sulfofatty acid esters (e.g., from palm kernel oil or coconut oil) are more soluble in water, but have lesser surface active agent properties. Suitable mixtures include $C_8$, $C_{10}$, $C_{12}$ and/or $C_{14}$ α-sulfofatty acid esters with $C_{16}$ and/or $C_{18}$ α-sulfofatty acid esters. For example, about 1 to about 99 percent of $C_8$, $C_{10}$, $C_{12}$ and/or $C_{14}$ α-sulofatty acid ester can be combined with about 99 to about 1 weight percent of $C_{16}$ and/or $C_{18}$ α-suifofatty acid ester. In another embodiment, the mixture comprises about 1 to about 99 weight percent of a $C_{16}$ or $C_{18}$ α-sulfofatty acid ester and about 99 to about 1 weight percent of a $C_{16}$ or $C_{18}$ α-sulfofatty acid ester. In yet another embodiment, the α-sulfofatty acid ester is a mixture of $C_{18}$ methyl ester sulfonate and a $C_{16}$ methyl ester sulfonate and having a ratio of about 2:1 to about 1:3. Particularly preferred are combinations of $C_{16}$ methyl ester sulfonate (MES) and $C_{18}$ MES, particularly eutectic MES (referred to herein as EMES) which has a C16:C18 ratio of about 50:50 to about 70:30 (for example, about 50:50, about 55:45, about 60:40, about 65:35, about 70:30, about 75:25, or about 80:20, and most particularly a C16:C18 ratio of about 70:30).

In one embodiment, the anionic surfactant is an alkyl ether sulfate of formula:

$$R^4O(CH_2CH_2O)_nSO_3M$$

where $R^4$ is an alkyl group of 8 to 22 carbon atoms, n ranges from 0.5 to 10 especially 1.5 to 8, and M is a solubilizing cation. In another embodiment, the alkyl ether sulfate is sodium lauryl ether sulphate (SLES).

Zwitterionic Surfactants

Suitable zwitterionic surfactants can be broadly described as derivatives of secondary and tertiary amines, derivatives of heterocyclic secondary and tertiary amities, or derivatives of quaternary ammonium, quaternary phosphonium or tertiary sulfonium compounds, such as those disclosed in U.S. Pat. No. 3,929,678, which is incorporated by reference herein.

Nonionic Surfactants

Suitable nonionic surfactants include polyalkoxylated alkanolamides, which are generally of the following formula (III):

$$R_4\overset{\overset{\displaystyle O}{\|}}{C}NR_6R_5(OR_7)_nH \qquad \text{(III)}$$

wherein $R_4$ is an alkane or hydroalkane, $R_5$ and $R_7$ are alkanes and n is a positive integer. $R_4$ is typically an alkane containing 6 to 22 carbon atoms. $R_5$ is typically an alkane containing 1-8 carbon atoms. $R_7$ is typically an alkane containing 1 to 4 carbon atoms, and more typically an ethyl group. The degree of polyalkoxylation (the molar ratio of the oxyalkyl groups per mole of alkanolamide) typically ranges from about 1 to about 100,or from about 3 to about 8, or about 5 to about 6. $R_6$ can be hydrogen, an alkane, a hydroalkane group or a polyalkoxylated alkane. The polyalkoxylated alkanolamide is typically a polyalkoxylated mono- or di-alkanolamide, such as a $C_{16}$ and/or $C_{18}$ ethoxylated monoalkanolamide, or an ethoxylated monoalkanolamide prepared from palm kernel oil or coconut oil.

Methods of manufacturing polyalkoxylated alkanolamides are known to the skilled artisan. (See, e.g., U.S. Pat. Nos. 6,04,257 and 6,034,257, the disclosures of which are incorporated by reference herein.) Sources of fatty acids for the preparation of alkanolamides include beef tallow, palm kernel (stearin or olein) oil, coconut oil, soybean oil, canola oil, cohune oil, palm oil, white grease, cottonseed oil, mixtures thereof and fractions thereof. Other sources include caprylic ($C_8$), capric ($C_{10}$), lauric ($C_{12}$), myristic ($C_{14}$), myristoleic ($C_{14}$), palmitic ($C_{16}$), palmitoleic ($C_{16}$), stearic ($C_{18}$), oleic ($C_{18}$), linoleic ($C_{18}$), linolenic ($C_{18}$), ricinoleic ($C_{18}$), arachidic ($C_{20}$), gadolic ($C_{20}$), behenic ($C_{22}$) and cradle ($C_{22}$) fatty acids. Polyalkoxylated alkanolamides from one or more of these sources are within the scope of the present invention.

The composition typically comprises an effective amount of polyalkoxylated alkanolamide (e.g., an amount which exhibits the desired surfactant properties). In some applications, the composition contains about 1 to about 10 weight percent of a polyalkoxylated alkanolamide. Typically, the composition comprises at least about one weight percent of polyalkoxylated alkanolamide.

Other suitable nonionic surfactants include those containing an organic hydrophobic group and a hydrophilic group that is a reaction product of a solubilizing group (such as a carboxylate, hydroxyl, amido or amino group) with an alkylating agent, such as ethylene oxide, propylene oxide, or a polyhydration product thereof (such as polyethylene glycol). Such nonionic surfactants include, for example, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, and alkylamine oxides. Other suitable surfactants include those disclosed in U.S. Pat. Nos. 5,945,394 and 6,046,149, the disclosures of which are incorporated herein by reference. In another embodiment, the composition is substantially free of nonylphenol nonionic surfactants. In this context, the term "substantially free" means less than about one weight percent.

Yet another nonionic surfactant useful herein comprises the amine oxide surfactants. In one embodiment of the present invention, liquid product comprises 0.1-20% (w/w), 1-15% (w/w), or 3.0-10% (w/w) of an amine oxide surfactant. Amine oxides are often referred to in the art as "semi-polar" nonionics, and have the formula: $R(EO)_x(PO)_y(BO)_zN(O)(CH_2R')_2.qH_2O$. In this formula, R is a relatively long-chain hydrocarbyl moiety which can be saturated or unsaturated, linear or branched, and can typically contain from 8 to 20, from 10 to 16 carbon atoms, or a $C_{12}$-$C_{16}$ primary alkyl. R' is a short-chain moiety such as a hydrogen, methyl and —$CH_2OH$. When x+y+z is different from 0, EO is ethyleneoxy, PO is propyleneneoxy and BO is butyleneoxy, i.e. $C_{2-14}$ alkyldimethyl amine oxide.

Suitable nonionic surfactants include alkoxylated fatty alcohols, ethylene oxide (EO)-propylene oxide (PO) block polymers, and amine oxide surfactants. Suitable for use in the liquid cleaning compositions herein are those nonionic surfactants which are normally liquid. Suitable nonionic surfactants for use herein include the alcohol alkoxylate nonionic surfactants. Alcohol alkoxylates are materials which correspond to the general formula of: $R_1(C_mH_{2m}O)_n$ OH, wherein $R_1$ is a $C_8$-$C_{16}$ alkyl group, m is from 2 to 4, and n ranges from 2 to 12; alternatively $R_1$ is an alkyl group, which may be primary or secondary, that contains from 9 to 15 carbon atoms, or from 10 to 14 carbon atoms. In another embodiment, the alkoxylated fatty alcohols will be ethoxylated materials that contain from 2 to 12, or 3 to 10, EO moieties per molecule. The alkoxylated fatty alcohol materials useful in the liquid compositions herein will frequently have a hydrophilic-lipophilic balance (HLB) which ranges from 3 to 17, from 6 to 15, or from 8 to 15. Alkoxylated fatty alcohol nonionic surfactants have been marketed under the tradenames Neodol and Dobanol by the Shell Chemical Company. Another nonionic surfactant suitable for use includes ethylene oxide (EO)-propylene oxide (PO) block polymers, such as those marketed under the tradename Pluronic. These materials are formed by adding blocks of ethylene oxide moieties to the ends of polypropylene glycol chains to adjust the surface active properties of the resulting block polymers.

Cationic Surfactants

Suitable cationic surfactants are quaternary ammonium surfactants. Suitable quaternary ammonium surfactants are selected from the group consisting of mono $C_6$-$C_{16}$, or $C_6$-$C_{10}$ N-alkyl or alkenyl ammonium surfactants, wherein the remaining N positions are substituted by methyl, hydroxyethyl or hydroxypropyl groups. Another cationic surfactant is $C_6$-$C_{18}$ alkyl or alkenyl ester of an quaternary ammonium alcohol, such as quaternary chlorine esters. In another embodiment, the cationic surfactants have the formula X—[($N^+R_1CH_3CH_3$)—$(CH_2CH_2O)_nH$], wherein $R_1$ is $C_8$-$C_{18}$ hydrocarbyl and mixtures thereof, or $C_{8-14}$ alkyl, or $C_8$, $C_{10}$ or $C_{12}$ alkyl, and X is an anion such as chloride or bromide.

Other suitable surfactants include amphoteric surfactants, zwitterionic surfactants, and mixtures thereof. Suitable amphoteric surfactants for uses herein include amido propyl betaines and derivatives of aliphatic or heterocyclic secondary and ternary amines in which the aliphatic moiety can be straight chain or branched and wherein one of the aliphatic substituents contains from 8 to 24 carbon atoms and at least one aliphatic substituent contains an anionic water-solubilizing group. When present, amphoteric surfactants typically comprise from 0.01% to 20%, or from 0.5% to 10%, by weight of the liquid detergent composition of the invention.

In one embodiment, the surfactant system of the liquid detergent composition of the invention comprises an anionic surfactant, a nonionic surfactant, or mixtures thereof. In another embodiment, the anionic surfactant is alkyl benzene sufonic acid, methyl ester sulfate, sodium lauryl ether sulfate, or mixtures thereof. In another embodiment, the nonionic surfactant is alcohol ethoxylate.

In one embodiment, the surfactant system is a mixture of at least one anionic and a nonionic surfactant. In another embodiment, the anionic surfactant is an alkyl benzene sulfonate. In another embodiment, the surfactant system is a mixture of at least two anionic surfactants. In one embodiment, the surfactant system comprises a mixture of an alkyl benzene sulfonate, an α-sulfofatty acid ester salt, and an alkyl ether sulfate. In another embodiment, the α-sulfofatty acid ester salt is methyl ester sulfonate, and the alkyl ether sulfate is sodium lauryl ether sulphate (SLES).

In one embodiment, the liquid detergent composition comprises a surfactant system having from about 5 wt % to about 25 wt % of at least one anionic surfactant, and from about 1 wt % to about 20 wt % of at least one nonionic surfactant. In another embodiment, the liquid detergent composition comprises from about 5 wt % to about 25 wt % of an anionic surfactant selected from the group consisting of alkyl benzene sulfonate, an α-sulfofatty acid ester salt, an alkyl ether sulfate, and mixtures thereof, and from about 1 wt % to about 20 wt % of a nonionic surfactant, which is an alcohol ethoxylate. In a particular embodiment, the liquid detergent composition comprises from about 5 wt % to about 25 wt % of an anionic surfactant selected from the group consisting of alkyl benzene sulfonate, methyl ester sulfonate, sodium lauryl ether sulphate, and mixtures thereof, and from about 1 wt % to about 20 wt % of a nonionic surfactant, which is an alcohol ethoxylate.

In certain embodiments, the surfactant system comprises about 15 to about 20 wt % of an anionic surfactant selected from the group consisting of alkyl benzene sulfonate, methyl ester sulfonate, sodium lauryl ether sulphate, and mixtures thereof, and about 15 to about 20 wt % of an alcohol ethoxylate. In other embodiments, the surfactant system comprises about about 8 to about 12 wt % of an anionic surfactant selected from the group consisting of alkyl benzene sulfonate, methyl ester sulfonate, sodium lauryl ether sulphate, and mixtures thereof, and about 1 to about 5 wt % of an alcohol ethoxylate. In other embodiments, the surfactant system comprises about about 5 to about 10 wt % of an anionic surfactant selected from the group consisting of alkyl benzene sulfonate, methyl ester sulfonate, sodium lauryl ether sulphate, and mixtures thereof, and about 4 to about 6 wt % of an alcohol ethoxylate. In other embodiments, the surfactant system comprises about 10 to about 15 wt % of an anionic surfactant selected from the group consisting of alkyl benzene sulfonate, methyl ester sulfonate, sodium lauryl ether sulphate, and mixtures thereof, and about 1 to about 15 wt % of an alcohol ethoxylate.

The Structuring Agent

The structuring agent of the present invention is a particulate cellulose material as defined herein per se, by dry weight, at least 60% cellulose, 0.5-10% pectin and 1-15% hemicellulose, and has a volume-weighted median particle dimension within the range of 25-75 μm, as measured by laser light diffractometry.

In one embodiment, the particulate cellulose material has a volume-weighted median particle dimension within the range of 35-65 μm, as measured by laser light diffractometry.

The parenchymal cellulose based materials, which comprise cell wall derived networks of cellulose based fibers and nanofibrils, can advantageously be used for stabilization of suspended solid particles or gas bubbles in the disclosed liquid detergent compositions and fragrance compositions.

Without wishing to be bound by any particular theory, it is assumed that, in the cellulose particles of the invention, the organization of the cellulose fibrils as it exists in the parenchymal cell walls is at least partly retained, even though part of the pectin and hemicellulose is removed there from. Furthermore, the cellulose based nanofibrils are not completely unraveled, i.e. the material is not primarily based on completely unraveled nanofibrils, but instead can be considered to comprise, as the main constituent, parenchymal cell wall debris, having substantial parts of the pectin and hemicellulose removed. It is hypothesized that at least some hemicellulose and/or pectin is to be retained in the material to support the structural organization of the cellulose in the particles, e.g. by providing an additional network. Such hemicellulose networks would hold the cellulose fibers together, thereby providing structural integrity and strength to the cellulose particle.

The particulate cellulose material is typically produced by subjecting parenchymal cell wall material to a process wherein part of the pectin and part of the hemicellulose is removed and the resulting material is subjected to shear so as to reduce the particle size to a certain extent. The parenchymal cell wall material can be derived from a variety of vegetable pulp materials, for example sugar beet pulp.

The use of ensilaged sugar beet pulp confers particular advantages. Ensilaging of sugar beet pulp typically involves conditions favorable to lactic acid fermentation resulting in lactic acid production and significant lowering of the pH. This beet pulp material is suitable for direct application in the process, using relatively mild chemical and mechanical treatment.

Materials may be utilized that, at present, are still mainly considered by-products in various industries, such as sugar refining industry. The production of particulate cellulose material from these by-products involves processing under generally mild conditions. As a result, also from a purely economic perspective, the particulate cellulose material is particularly attractive.

The particulate cellulose material is derived from parenchymal cell containing plant pulp. Parenchymal cell walls contain relatively thin cell walls (compared to secondary cell walls) which are tied together by pectin. Secondary cell walls are much thicker than parenchymal cells and are linked together with lignin This terminology is well understood in the art. Polysaccharides typically can make up 90% or more of the primary plant cell walls, cellulose, hemicelluloses and pectins being the main constituents. The precise morphology and (chemical) make-up of parenchymal cell walls may vary considerably from species to species. In one embodiment, the particulate cellulose material in accordance with the invention is obtained from sugar beet, e.g. as a by-product of sucrose production.

The particulate cellulose material contains particles of specific structure, shape and size, as explained herein before. Typically the material contains particles having the form of platelets comprising parenchymal cellulose structures or networks. The size distribution of the particulate material typically falls within certain limits. When the distribution is measured with a laser light scattering particle size analyzer, such as the Malvern Mastersizer or another instrument of equal or better sensitivity, the diameter data is preferably reported as a volume distribution. Thus the reported median for a population of particles will be volume-weighted, with about one-half of the particles, on a volume basis, having diameters less than the median diameter for the population. Typically, the median major dimension of the particles of the parenchymal cellulose composition is within the range of 25-75 μm. In another embodiment, the median major dimension of the particles of the parenchymal cellulose composition is within the range of 35-65 μm. Typically at least 90%, on a volume basis, of the particles has a diameter less than 120 μm, less than 110 μm, or less than 100 μm. Typically at least 90%, on a volume basis, of the particles has a diameter above 5 μm, above 10 μm, or above 25 μm. In an embodiment, the particulate cellulose material has a volume-weighted median minor dimension larger than 0.5 μm, or larger than 1 μm.

The term "cellulose" as used herein refers to homogeneous long chain polysaccharides comprised of β-D-glucose monomer units, of formula $(C_6H_{10}O_5)_n$, and derivatives thereof usually found in plant cell walls in combination with lignin and any hemicellulose. The parenchymal cellulose of this invention may be obtained from a variety of plant sources containing parenchymal cell walls. Parenchymal cell wall, which may also be denoted as 'primary cell wall', refers to the soft or succulent tissue, which is the most abundant cell wall type in edible plants. In one embodiment, the particulate cellulose material comprises, by dry weight, at least 60 wt %, at least 70 wt %, at least 80 wt %, or at least 90 wt % of cellulose.

The particulate cellulose component has a majority of the cellulose material in the form of particles that are distinct from the nanofibrilised cellulose described in the prior art in that the cellulose nanofibrils are not substantially unraveled, as discussed before. In one embodiment, less than 10%, less than 1% or less than 0.1% by dry weight of the cellulose within the composition is in the form of nanofibriliated cellulose. This is advantageous as nanofibriliated cellulose negatively affects the ability of the material to be processed and/or (re)dispersed. The term 'nanofibrils' refers to the fibrils making up the cellulose fibers, typically having a width in the nanometer range and a length of between up to 20 μm. It is to be noted that the nomenclature used in the field over the past decades has been somewhat inconsistent in that the terms 'microfibril' and 'nanofibril' have been used to denote the same material.

The plant parenchymal cellulose material has been treated, modified and/or some components may have been removed but the cellulose has not substantially been broken down to individual nanofibrils, thereby substantially losing the structure of plant cell wall sections.

As mentioned before, the particulate cellulose component has a reduced pectin content, as compared to the parenchymal cell wall material from which it is derived. Removal of some of the pectin is believed to result in enhanced thermal stability. The term "pectin" as used herein refers to a class of plant cell-wall heterogeneous polysaccharides that can be extracted by treatment with acids and chelating agents. Typically, 70-80% of pectin is found as a linear chain of α-(1-4)-linked D-galacturonic acid monomers. The smaller RG-I fraction of pectin is comprised of alternating (1-4)-linked galacturonic acid and (1-2)-linked L-rhamnose, with substantial arabinogalactan branching emanating from the L-rhamnose residue. Other monosaccharides, such as D-fucose, D-xylose, apiose, aceric acid, Kdo, Dha, 2-O-methyl-D-fucose, and 2-O-methyl-D-xylose, are found either in the RG-II pectin fraction (<2%), or as minor constituents in the RG-I fraction.

In one embodiment, the particulate cellulose material comprises less than 5 wt % of pectin, or less than 2.5 wt %, by dry weight of the particulate cellulose material. The presence of at least some pectin in the cellulose material is nevertheless desired. Without wishing to be bound by any theory it is assumed that pectin plays a role in the electrostatic interactions between particles contained in the material and/or in supporting the network/structure of the cellulose. Additionally, the presence of some pectin might affect the capability of certain enzymes, e.g. those typically used in laundry detergent products, to degrade the cellulose in the particulate cellulose material. In one embodiment, the particulate cellulose material contains at least 0.5 wt %, or at least 1 wt %, of pectin by dry weight of the particulate cellulose material.

As mentioned before, the particulate cellulose material has a certain minimum content of hemicellulose. The term "hemicellulose" refers to a class of plant cell-wall polysaccharides that can be any of several homo- or heteropolymers. Typical examples thereof include xylane, arabinane xyloglucan, arabinoxylan, arabinogalactan, glucuronoxylan, glucomannan and galactomannan. Monomeric components of hemicellulose include, but are not limited to: D-galactose, L-galactose, D-mannose, L-rhamnose, L-fucose, D-xylose, L-arabinose, and D-glucuronic acid. This class of polysaccharides is found in almost all cell walls along with cellulose. Hemicellulose is lower in molecular weight than cellulose and cannot be extracted by hot water or chelating agents, but can be extracted by aqueous alkali. Polymeric chains of hemicellulose bind pectin and cellulose in a network of cross-linked fibers forming the cell walls of most plant cells. Without wishing to be bound by any theory, it is assumed that the presence of at least some hemicellulose is important to the structural organization of the fibers making up the particulate material. Additionally, the presence of some hemicellulose might affect the capability of certain enzymes, e.g. those typically used in laundry detergent products, to degrade the cellulose in the material of the invention. In one embodiment, the particulate cellulose material comprises, by dry weight of the particulate cellulose material, 1-15 wt % hemicellulose, 1-10 wt % hemicellulose, 1-5 wt % hemicellulose.

Compositions of the structuring agent typically may take the form of an aqueous suspension or paste like 'additive', which can conveniently be dispersed in the fluid products in order to confer the desired rheological behavior. Embodiments are also envisaged wherein the parenchymal cellulose material is provided in powder form, which can be redispersed in fluid products. Composition containing the parenchymal cellulose materials typically can comprise other materials, as will be understood by those skilled in the art. Such other materials can include, e.g., remnants from (the processing of) the raw plant cell wall source (other than the particulate cellulose material of the invention) and any sort of additive, excipient, carrier material, etc., added with a view to the form, appearance and/or intended application of the composition.

A particulate cellulose material can be obtained using a specific process, which process involves a step of mild alkali treatment to hydrolyse the cell wall material followed by an intense homogenization process which does however not result in the complete unraveling of the material to its individual nanofibrils.

The parenchymal cellulose composition is prepared by:

(a) providing a parenchymal cell containing plant pulp, vegetable pulp, or sugar beet pulp;

(b) subjecting the parenchymal cell containing vegetable pulp to chemical and/or enzymatic treatment resulting in partial degradation and/or extraction of pectin and hemicellulose; and (c) subjecting the material resulting from step b) to a high shear process, wherein the particle size of the cellulose material is reduced so as to yield a particulate material having a volume-weighted median major dimension within the range of 25-75 μm, as measured by laser diffraction analysis.

Alternatively, the parenchymal cellulose composition is prepared by:

(a) providing a parenchymal cell containing vegetable pulp;

(b) subjecting the parenchymal cell containing vegetable pulp to chemical and/or enzymatic treatment resulting in partial degradation and/or extraction of pectin and hemicellulose, wherein the mixture may be homogenized once or several times by applying low shear force during and/or after said chemical and/or enzymatic treatment;

(c) subjecting the material resulting from step b) to a high shear process, wherein the particle size of the cellulose material is reduced so as to yield a particulate material having a volume-weighted median major dimension within the range of 25-75 μm, as measured by laser diffraction analysis; and (d) removing liquid from the mass obtained in step c).

As is known by those skilled in the art, in biology, the term "vegetable" means originating from and/or pertaining to any member of the plant kingdom and, in the context of this invention the terms 'vegetable pulp' and 'plant pulp' are deemed to be fully interchangeable. The parenchymal cell containing pulp used as the starting material typically comprises an aqueous slurry comprising ground and/or cut plant materials, which often can be derived from waste streams of other processes, in particular sugar beet pulp.

In one embodiment, fresh, pressed-out sugar beet pulp from which the sugars have been extracted is used. In another aspect, the sugar beet pulp has a dry solids content of 10-50 wt. %, 20-30 wt. %, or approximately 25 wt. %. Sugar beet pulp is the production residuum from the sugar beet industry. More specifically, sugar beet pulp is the residue from the sugar beet after the extraction of sucrose there from. Sugar beet processors usually dry the pulp. The dry sugar beet pulp can be referred to as "sugar beet shreds". Additionally, the dry sugar beet pulp or shreds can be formed and compressed to produce "sugar beet pellets". These materials may all be used as the starting material, in which case step a) will comprise suspending the dry sugar beet pulp material in an aqueous liquid, typically to the afore-mentioned dry solids contents. In one embodiment, fresh wet sugar beet pulp is used as the staring material.

Another starting material is ensilaged vegetable pulp, especially ensilaged sugar beet pulp. As used herein, the term "ensilage" refers to the process of storing vegetable materials in a moist state under conditions resulting in acidification caused by anaerobic fermentation of carbohydrates present in the materials being treated. As a raw material, ensilaged beet pulp provides advantages in performance, processing and cost.

Ensilage is carried out according to known methods with pulps containing about 15 to 35% of dry matter. Ensilage of sugar beets is continued until the pH is within the range of 3.5-5. The fermentation process starts spontaneously under anaerobic conditions with the lactic acid bacteria being inherently present. These microorganisms convert the residual sucrose of the pressed beet pulp to lactic acid, causing a fall in the pH. The storing of the sugar beet pulp under these conditions confers specific characteristics that are advantageous in the further processing of the material and/or with a view of the characteristics of the material obtained accordingly.

Under certain methods of ensilaging, the vegetable pulp material is 'actively' inoculated with lactic acid producing bacteria. This would allow selecting specific strains. Conditions favorable to the growth of the lactic acid bacteria are known by those skilled in the art. In an embodiment of the invention, the process comprises placing the vegetable pulp in a silo or building a closely packed stack of the vegetable pulp and creating and maintaining an anaerobic environment during the growth of the bacteria. Typically, the temperature of the vegetable pulp during bacterial growth is not manipulated. In one embodiment, bacterial growth steps do not involve the application of external heat. In some embodiments measures may be applied in bacterial growth steps to prevent excessive heating.

Other examples of vegetable pulps that may be employed include, but are not limited to, pulps obtained from chicory, beet root, turnip, carrot, potato, citrus, apple, grape, or tomato,. Such pulps are typically obtained as side-streams in conventional processing of these vegetable materials. In one embodiment the use of potato pulp obtained after starch extraction is envisaged. In another, the use of potato peels, such as obtained in steam peeling of potatoes, is envisaged. In some embodiments, the use of press pulp obtained in the production of fruit juices is envisaged.

The parenchymal cell containing vegetable pulp can be washed in a flotation washer before the chemical or enzymatic treatment of step b) is carried out, in order to remove sand and clay particles and, in case ensilaged sugar beet pulp is used as a starting material, in order to remove soluble acids.

The chemical and/or enzymatic treatment of step b) results in the degradation and/or extraction of at least a part of the pectin and hemicelluloses present in the parenchymal cell containing vegetable pulp, typically to monosaccharides, disaccharides and/or oligosaccharides, typically containing three to ten covalently hound monosaccharides. However, as indicated above, the presence of at least some pectin, such as at least 0.5 wt %, and some hemicellulose, such as 1-15 wt %, is preferred. As will be understood by those skilled in the art, said pectin and hemicellulose remaining in the cellulose material can be non-degraded and/or partially degraded. Hence, step b) typically comprises partial degradation and extraction of the pectin and hemicellulose, preferably to the extent that at least 0.5 wt. % of pectin and at least 1 wt. % of hemicellulose remain in the material. It is within the routine capabilities of those skilled in the art to determine the proper combinations of reaction conditions and time to accomplish this.

The chemical or enzymatic treatment can be followed by removing at least part of the water, with the aim of removing a substantial fraction of dissolved and/or dispersed matter. The mass may be subjected to filtration, e.g. in a chamber filter press. As will be understood by those skilled in the art, it is possible to incorporate multiple processing steps in order to achieve optimal results. For example, the mixture can be filtered, followed by the addition of water or liquid followed by an additional step of removing liquid, e.g. using a chamber filter press, to result in an additional washing cycle. This step may be repeated as many times as desired in order to achieve a higher degree of purity.

At least a part of the pectin and hemicelluloses may be degraded by treatment of the vegetable pulp with suitable enzymes. A specific enzyme or a combination of enzymes can be employed to get an optimum result. Generally an enzyme combination is used with a low cellulase activity relative to the pectinolytic and hemicellulolytic activity. Alternatively, a combination of enzymes can be employed, having the following activities, expressed as percentage of the total activity of the combination:

cellulase activity of 0-10%;

pectinolytic activity of 50-80%; and hemicellulase activity of at least 20-40%

The enzyme treatments are generally carried out under mild conditions, e.g. at pH 3.5-5 and at 35-50° C., typically for 16-48 hours, using an enzyme activity of e.g. 65.000-150.000 units/kg substrate (dry matter). It is within the routine capabilities of those skilled in the art to determine the proper combinations of parameters to accomplish the desired rate and extent of pectin and hemicellulose degradation.

Before, during or after step b) the mixture is homogenized once or several times by applying low shear force. Low shear force can be applied using standard methods and equipment known to those skilled in the art, such as conventional mixers or blenders. In one embodiment, the step of homogenization at low shear is carried out for at least 5 minutes, at least 10 minutes, or at least 20 minutes.

It is beneficial to subject the mass resulting from step b) to treatment with an acid, in particular sulphuric acid. This step typically is performed to dissolve and optionally remove various salts from the material, but it may affect the material in different ways as well. Hence, the treatment of step b) can additionally comprises mixing the treated parenchymal cell containing pulp with an acid in an amount to lower the pH to below 4, below 3, or below 2. In one embodiment, said acid is sulphuric acid. After addition of the acid, the mixture is homogenized once or several times by applying low shear force, using e.g. conventional mixers or blenders. In one embodiment, the step of homogenisation at low shear is carried out for at least 5 minutes, at least 10 minutes, or at least 20 minutes.

Step c) involves high shear treatment of the mass resulting from step b), which will typically result in cellulose platelets being e.g. less than half the size of the parent cells, or less than one third the size of the parent cells. As mentioned before, it is important to retain part of the structure in the cellulose particles to ensure that the composition provides the advantageous characteristics described herein. As will be understood from the foregoing, the processing during step d) should not result in the complete or substantial unraveling to nanofibrils.

The process of obtaining the desired particle size characteristics of the cellulose material in step c) is not particularly limited and many suitable methods are known to those Skilled in the art. Examples of suitable size reducing techniques include grinding, crushing or microfluidization. Suitably the process is conducted as wet processes, typically by subjecting the aqueous liquid from step b), which may e.g. contain 1 to 50% cellulosic material, to grinding, crushing, microfluidization or the like.

Examples of high shear equipment for use in step c) include friction grinders, such as the Masuko supermasscolloider; high pressure homogenizers, such as a Gauhn homogeninizer, high shear mixers, such as the Silverson type FX; in line homogenizer, such as the Silverson or Supraton in line homogenizer; and microfluidizers. The use of this equipment in order to obtain the required particle properties is a matter of routine for those skilled in the art. The methods described here above may be used alone or in combination to accomplish the desired size reduction.

Heating can be discontinued after step b) and the mass allowed to cool in between steps b) and c) or it may be transferred to the homogenizer directly, where no additional heating takes place. In one embodiment, step c) is performed while the material is at ambient temperature. In another embodiment, step c) is performed while the material is at above-ambient temperature, e.g. at temperatures of up to 80° C. Alternatively, step c) is performed at a temperature within the range of 60-80° C.

After the step of reducing the particle size of the cellulose, a separation on the basis of particle size can be carried out. Examples of useful separation techniques are sieve classification, membrane filtration and separations using a cyclone or centrifuge.

Removal of water during step d) is primarily to remove a substantial fraction of dissolved organic material as well as a fraction of unwanted dispersed organic matter, i.e. having a particle size well below the particle size range of the particulate cellulose material.

In view of the first objective, it is preferred not to use methods relying on evaporation, as will be understood, since this will not remove any of the dissolved salts, pectin, proteins, etc., which are exactly the components to be washed out by this step. In one embodiment, step d) does not comprise a drying step, such as evaporation, vacuum drying, freeze-drying, spray-drying, etc. In another embodiment, the mass may be subjected to microfiltration, dialysis, centrifuge decantation or pressing.

As will be understood by those skilled in the art, it is possible to incorporate multiple processing steps in order to achieve optimal results. For example, an embodiment is envisaged wherein step d) comprises subjecting the mixture to microfiltration, dialysis or centrifuge decantation, or the like, followed by a step of pressing the composition.

As will be understood by those skilled in the art, step d) may also comprise the subsequent addition of water or liquid followed by an additional step of removal of liquid, e.g. using the above described methods, to result in an additional washing cycle. This step may be repeated as many times as desired in order to achieve a higher degree of purity.

In one embodiment, following step d), the composition is added to an aqueous medium and the cellulose particles within the composition are rehydrated and uniformly suspended within the aqueous medium. In one embodiment, the cellulose particles are suspended by (low shear) mixing. Rehydration under low shear mixing ensures that the energy cost to rehydrate is low and that the cellulose platelets are not damaged, or that a significant proportion of the cellulose platelets are not damaged during the mixing process.

In one embodiment, step d) is performed while the material is at ambient temperature. In another embodiment, step d) is performed while the material is at above-ambient temperature, e.g. at temperatures of up to 85° C. In one embodiment of the invention, step d) is performed at a temperature within the range of 60-85° C.

Once compositions comprising the particulate cellulose material have been produced, it is often desirable to increase the concentration of the cellulose material to reduce the volume of the composition and thereby e.g. reduce storage and transport costs. Accordingly, the composition of cellulose platelets may be concentrated, e.g. to at least 5 wt % solids, or at least 10 wt % solids, that may be added in small quantities to the detergent compositions or fragrance compositions to confer the desired structuring properties.

Rheology Parameters

The particulate cellulose material is applied in the liquid detergent compositions in accordance with the present invention to produce a yield stress within the range of 0.003-5.0 Pa, within the range of 0.01-1.0 Pa, or within the range of 0.05-0.2 Pa.

The incorporation of the particulate cellulose material in the liquid detergent compositions results in the fluid water-based composition becoming shear thinning. Shear thinning, as used herein, means that the fluid's resistance to flow decreases with an increase in applied shear stress. Shear thinning is also referred to in the art as pseudoplastic behavior. Shear thinning can be quantified by the so called "shear thinning factor" (SF) which is obtained as the ratio of viscosity at 1 $s^{-1}$ and at 10 $s^{-1}$: A shear thinning factor below zero (SF<0) indicates shear thickening, a shear thinning factor of zero (SF=0) indicates Newtonian behavior and a shear thinning factor above zero (SF>0) stands for shear thinning behavior. In an embodiment of the invention, the shear thinning property is characterized by the liquid matrix having a specific pouring viscosity, a specific low-stress viscosity, and a specific ratio of these two viscosity values.

The pouring viscosity, as defined herein, is measured at a shear rate of 20 $s^{-1}$. In an embodiment of the invention, a pouring viscosity is attained ranging from about 50 to about 1000 mPa·s, or from 100 to 1000 mPa·s, about 200 to about 800 mPa·s, about 200 to about 600 mPa·s, about 400 to about 800 mPa·s, or about 400 to about 600 mPa·s.

The low-shear viscosity, as defined herein, is determined under a constant low-stress of 0.1 Pa. The incorporation of the particulate cellulose material into liquid detergent compositions typically results in a low-stress viscosity of at least $10^4$ mPa·s, at least $10^5$ mPa·s, or at least $10^6$ mPa·s.

The zero-shear viscosity is a not a direct measurement but a calculus or extrapolation from measurements at lower shear rate values. In one embodiment, the incorporation of the particulate cellulose material in the liquid detergent compositions typically results in a zero-stress viscosity of at least $10^4$ mPa·s, at least $10^5$ mPa·s, or at least $10^6$ mPa·s.

To exhibit suitable shear-thinning characteristics, in one embodiment, the incorporation of the particulate cellulose material in the liquid detergent compositions in accordance with the present invention typically results in a ratio of low-stress viscosity to pouring viscosity value, which is at least 2, at least 10, or at least 100, up to 1000 or 2000.

The incorporation of the particulate cellulose material in the liquid detergent compositions typically results in the liquid detergent compositions becoming thixotropic. Thixotropy is a shear thinning property. Thixotropic compositions show shear thinning over time when a stress is applied and need some time to return to the more viscous state when the stress is removed. Thixotropic materials are characterized by a hysteresis loop. The hysteresis loop is a flow curve, obtained by measurements on a viscometer, showing for each value of rate of shear, two values of shearing stress, one for an increasing rate of shear and the other for a decreasing rate of shear. Hence, the "up curve" and "down curve" do not coincide. This phenomenon is caused by the decrease in the fluid's viscosity with increasing time of shearing. Such effects may or may not be reversible; some thixotropic fluids, if allowed to stand undisturbed for a while, will regain their initial viscosity, while others never will. The present inventors established that the liquid detergent compositions of this invention are characterized by complete and relatively fast recovery of the initial viscosity. Typically, the "up curve" and "down curve" are relatively close and the "up" curves" as well as the "down curves" of subsequent measurement cycles will coincide completely or nearly completely. As will be understood by those skilled in the art, this capability to regain initial viscosity quickly and completely is a particular advantage.

Also, in one embodiment, the incorporation of the particulate cellulose material in the liquid detergent compositions typically results in a stress v. shear rate profile with a slope of at least 0.05, at least 0.1, at least 0.2, at least 0.3, at least 0.4 or at least 0.5. The incorporation of the particulate cellulose material in the liquid detergent compositions furthermore typically results in a stress v. shear rate profile with a slope of below 1.5, below 1, below 0.9, below 0.8, below 0.7, below 0.6 or below 0.5. More in particular, a stress v, shear rate profile is attained with a slope of >0, of at least 0.05, at least 0.1, at least 0.2, at least 0.3, at least 0.4 or at least 0.5, within the shear rate range of from 1 to 1000 $s^{-1}$, 10 to 1000 $s^{-1}$, from 10 to 100 $s^{-1}$. As will be understood by those skilled in the art on the basis of the information mentioned herein, the >0 slope typically means that the product has sufficient flow stability and is less prone to shear banding and lumpiness.

Unless indicated otherwise, viscosity and flow behavior measurements, in accordance with this invention, are performed using a Haake model VT550 viscometer (spindle MV1), at 1 to 1000 $s^{-1}$ and conducted at 25° C.

Rheology parameters defined herein concern the combination of the aqueous liquid or fluid and the particulate cellulose material. The presence of suspended particles can influence yield stress measurements. The above-defined values can typically be attained with systems comprising the particulate cellulose material at a level within the ranges disclosed herein.

The term "aqueous liquid or fluid" is used herein to generally refer to the liquid or fluid matrix containing the particulate cellulose material and the surfactant system, which contains a liquid continuous phase with water as the main solvent. Besides water, the aqueous liquid or fluid can contain significant amounts of solutes, other solvents and/or colloidal components dispersed within the continuous aqueous phase, as will be appreciated by those skilled in the art. In an embodiment, the aqueous liquid or fluid comprises water in an amount of at least 50% (w/w), at least 60% (w/w), at least 70% (w/w), at least 80% (w/w), or at least 90% (w/w). Embodiments are however also envisaged, wherein the aqueous liquid or fluid comprises water in amounts of only 5% (w/w) or more, eg. in combination with other water-miscible solvents such as ethanol.

In an embodiment, the liquid detergent composition comprises water in an amount of at least 10% (w/w), at least 20% (w/w), at least 25% (w/w), or at least 30% (w/w). Furthermore, in an embodiment, the liquid detergent composition comprises water in an amount of less than 85% (w/w), less than 75% (w/w), less than 70% (w/w), less than 60% (w/w), less than 50% (w/w), less than 40% (w/w), or less than 35% (w/w). In certain embodiments the liquid detergent composition is a concentrated formulation comprising as low as 1 to 30% (w/w) water, e.g. from 5 to 15% (w/w), or from 10 to 1.4% (w/w).

It has been found that the particulate cellulose material is capable of providing the desired structuring benefits at pH values within the entire range of 1-14. It has importantly been found that the particulate cellulose material is capable of providing the desired structuring benefits at extremely low pH values, which is a particular advantage of the present invention. In one embodiment, therefore, the aqueous liquid or fluid has a pH of below 6, below 5, below 4, below 3, or below 2

The aqueous medium may comprise any amount of dissolved components. It will be understood by those skilled in the art that a wide variety of such components may suitably be included in the fluid water-based compositions and in a wide range of Concentrations, the exact preferences depending entirely on the type of product to be constituted by the liquid detergent composition. The particulate cellulose material retains most of its favourable rheology characteristics in the presence of high levels of electrolytes, at a wide range of pH values and/or in the presence of oxidizing and/or reducing agents.

Other Components

The liquid detergent composition of the present invention optionally comprises other ingredients that can typically be present in detergent products and/or personal care products to provide further benefits in terms of cleaning power, solubilization, appearance, fragrance, etc.

Builders

Other suitable components include organic or inorganic detergency builders. Examples of water-soluble inorganic builders that can be used, either alone or in combination with themselves or with organic alkaline sequestrant builder salts, are glycine, alkyl and alkenyl succinates, alkali metal carbonates, alkali metal bicarbonates, phosphates, polyphosphates and silicates. Specific examples of such salts are sodium. tripolyphosphate, sodium carbonate, potassium carbonate, sodium bicarbonate, potassium bicarbonate, sodium pyrophosphate and potassium pyrophosphate. Examples of organic builder salts that can be used alone, or in combination with each other, or with the preceding inorganic alkaline builder salts, are alkali metal polycarboxylates, water-soluble citrates such as sodium and potassium citrate, sodium and potassium tartrate, sodium and potassium ethylenediaminetetracetate, sodium and potassium N(2-hydroxyethyl)-nitrilo triacetates, sodium and potassium N-(2-hydroxyethyl)-nitrilo diacetates, sodium and potassium oxydisuccinates, and sodium and potassium tartrate mono- and di-succinates, such as those described in U.S. Pat. No. 4,663,071, the disclosure of which is incorporated herein by reference.

Enzymes

Suitable enzymes include those known in the art, such as amylolytic, proteolytic, cellulolytic or lipolytic type, and those listed in U.S. Pat. No. 5,958,864, the disclosure of which is incorporated herein by reference. One protease, sold under the trade name SAVINASE® by Novozymes A/S, is a subtillase from *Bacillus lentus*. Other suitable enzymes include proteases, amylases, lipases and cellulases, such as ALCALASE® (bacterial protease), EVERLASE® (protein-engineered variant of SAVINASE®), ESPERASE® (bacterial protease), LIPOLASE® (fungal lipase), LIPOLASE ULTRA (Protein-engineered variant of LIPOLASE), LIPOPRIME® (protein-engineered variant of LIPOLASE), TERMAMYL® (bacterial amylase), BAN (Bacterial Amylase Novo), CELLUZYME® (fungal enzyme), and CAREZYME® (monocomponent cellulase), sold by Novozymes A/S. Additional enzymes of these classes suitable for use in accordance with the present invention will be well-known to those of ordinary skill in the art, and are available from a variety of commercial suppliers including but not limited to Novozymes A/S and Genencor/Danisco.

Foam Stabilizers

Suitable foam stabilizing agents include a polyalkoxylated alkanolamide, amide, amine oxide, betaine, sultaine, $C_8$-$C_{18}$ fatty alcohols, and those disclosed in U.S. Pat. No. 5,616,781, the disclosure of which is incorporated by reference herein. Foam stabilizing agents are used, for example, in amounts of about 1 to about 20, typically about 3 to about 5 percent by weight. The composition can further include an auxiliary foam stabilizing surfactant, such as a fatty acid amide surfactant. Suitable fatty acid amides are $C_8$-$C_{20}$ alkanol amides, monoethanolamides, diethanolamides, and isopropanolamides.

Colorants

In some embodiments, the liquid detergent composition does not contain a colorant.

In some embodiments, the liquid detergent composition contains one or more colorants. The colorant(s) can be, for example, polymers. The colorant(s) can be, for example, dyes. The colorant(s) can be, for example, water-soluble polymeric colorants.

The colorant(s) can be, for example, water-soluble dyes. The colorant(s) can be, for example, colorants that are well-known in the art or commercially available from dye or chemical manufacturers.

The color of the colorant(s) is not limited, and can be, for example, red, orange, yellow, blue, indigo, violet, or any combination thereof. The colorant(s) can be, for example, one or more Milliken LIQUITINT colorants. The colorant(s) can be, for example Milliken LIQUITINT: VIOLET LS, ROYAL MC, BLUE HP, BLUE MC, AQUAMARINE, GREEN HMC, BRIGHT YELLOW, YELLOW LP, YELLOW BL, BRILLIANT ORAGNE, CRIMSON, RED MX, PINK AL, RED BL, RED ST, or any combination thereof.

The colorant(s) can be, for example, one or more of Acid Blue 80, Acid Red 52, and Acid Violet 48.

Acid Blue 48 has the chemical structure:

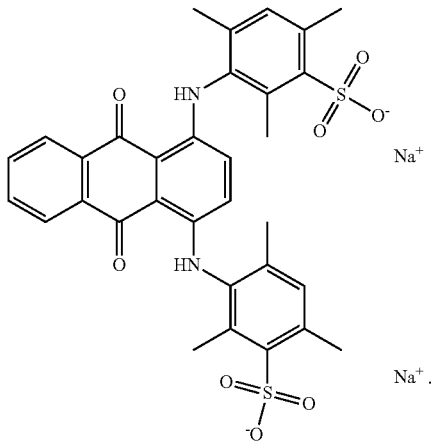

Acid Red 52 has the chemical structure:

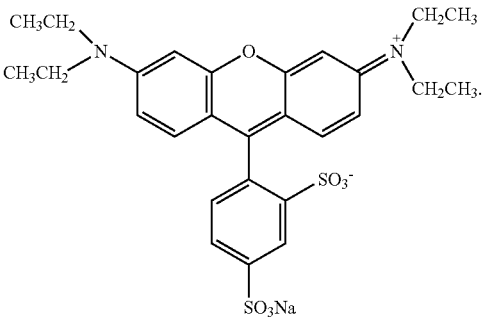

Acid Violet 48 has the chemical structure:

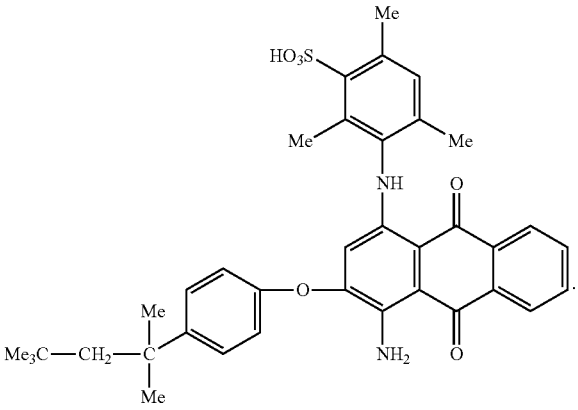

When the colorant(s) are selected from the group consisting of Acid Blue 80, Acid Red 52, and Acid Violet 48, the liquid detergent composition, optionally, does not contain a colorant stabilizer. Surprisingly, it has been found that Acid Blue 80, Acid Red 52, and Acid Violet 48, do not display significant discoloration over time, and thus, can be used without (e.g., in the absence of a colorant stabilizer.

The total amount of the one or more colorant(s) that can be contained in the liquid detergent composition, for example, can range from about 0.00001% by weight to about 0.099% by weight. The total amount of colorant(s) in the liquid detergent composition can be, for example, about 0.0001% by weight, about 0.001% by weight, about 0.01% by weight, about 0.05% by weight, or about 0.08% by weight.

Colorant Stabilizer(s)

In some embodiments, the liquid detergent composition can optionally contain a colorant stabilizer. Colorant stabilizers have been disclosed herein. In some embodiments, the colorant stabilizer can be citric acid.

The total amount of the optionally present colorant stabilizer(s) in the liquid detergent composition can range, for example, from about 0.01% by weight to about 5.0% by weight. The total amount of the colorant stabilizer(s) in the SWCCA can be, for example, about 0.1% by weight, about 1% by weight, about 2% by weight, about 3% by weight, or about 4% by weight.

Fragrance(s)

The liquid detergent composition can optionally contain one or more fragrances. Fragrances are discussed, for example, in U.S. Pat. No. 6,056,949. The contents of U.S. Pat. No. 6,056,949 are incorporated by reference in their entirety.

When present, the fragrance can be contained for example, in an amount ranging from about 0.1% by weight to about 10% by weight, based on the volume of the detergent composition. The fragrance can be contained, for example, in an amount of about 0.2% by weight, about 0.3% by weight, about 0.4% by weight, about 0.5% by weight, about 0.6% by weight, about 0.7% by weight, about 0.8% by weight, about 0.9% by weight, about 1.0% by weight, about 2.0% by weight, about 3.0% by weight, about 4.0% by weight, about 5.0% by weight, about 6.0% by weight, about 7.0% by weight, about 8.0% by weight, or about 9.0% by weight, based on the volume of the detergent composition.

The fragrance can be contained, for example, in an amount ranging from about 0.1% by weight to about 10% by weight, about 0.1% by weight to about 9% by weight, about 0.1% by weight to about 8% by weight, about 0.1% by weight to about 7% by weight, about 0.1% by weight to about 6% by weight, about 0.1% by weight to about 5% by weight, about 0.1% by weight to about 4% by weight, about 0.1% by weight to about 3% by weight, about 0.1% by weight to about 2% by weight, or about 0.1% by weight to about 1% by weight, based on the volume of the detergent composition.

The fragrance can be contained, from example, in an amount ranging from about 1% by weight to about 10% by weight, about 2% by weight to about 10% by weight, about 3% by weight to about 10% by weight, about 4% by weight to about 10% by weight, about 5% by weight to about 10% by weight, about 6% by weight to about 10% by weight, about 7% by weight to about 10% by weight, about 8% by weight to about 10% by weight, or about 9% by weight to about 10% by weight, based on the volume of the detergent composition.

The fragrance can be contained, for example, in an amount ranging from about 4% by weight to about 6% by weight, about 3% by weight to about 7% by weight, about 2% by weight to about 8% by weight, or about 1% by weight to about 9% by weight, based on the volume of the detergent composition.

In one embodiment, the invention is a fragrance composition, comprising about 10-75 wt % of a fragrance component and from about 0.01-1 wt % of an external structuring agent, comprising particulate cellulose material containing, by dry weight, at least 60% cellulose, 0.5-10% pectin and 1-15% hemicellulose, and has a volume-weighted median particle dimension within the range of 25-75 μm, as measured by laser light diffractometry.

The fragrance can comprise an ester, an ether, an aldehyde, a ketone, an alcohol, a hydrocarbon, or any combination thereof.

The fragrance can have, for example, a musky scent, a putrid scent, a pungent scent, a camphoraceous scent, an ethereal scent, a floral scent, a peppermint scent, or any combination thereof.

In one embodiment, the fragrance can comprise methyl formate, methyl acetate, methyl butyrate, ethyl butyrate, isoamyl acetate, pentyl butyrate, pentyl pentanoate, octyl acetate, myrcene, geraniol, nerol, citral, citronellol, linalool, nerolidol, limonene, camphor, terpineol, alpha-ionone, thujone, benzaldehyde, eugenol, cinnamaldehyde, ethyl maltol, vanillin, anisole, anethole, estragole, thymol, indole, pyridine, furaneol, 1-hexanol, cis-3-hexenal, furfural, hexyl cinnamaldehyde, fructone, hexyl acetate, ethyl methyl phenyl glycidate, dihydrojasmone, oct-1-en-3-one, 2-acetyl-1-pyrroline, 6-acetyl-2,3,4,5-tetrahydropyridine, gamma-decalactone, gamma-nonalactone, delta-octalone, jasmine lactone, massoia lactone, wine lactone, sotolon, grapefruit mercaptan, methanthiol, methyl phosphine, dimethyl phosphine, nerolin, 2,4,6-trichloroanisole, or any combination thereof.

In one embodiment, the fragrance can contain, for example, a linear terpene, a cyclic terpene, an aromatic compound, a lactone, a thiol, or any combination thereof.

In one embodiment, the fragrance is High Five ACM 190991 F (Firmenich), Super Soft Pop 190870 (Firmenich), Mayflowers TD 485531 EB (Firmenich), or any combination thereof. Other art-known fragrances, or any fragrance commercially available from a fragrance supplier (e.g. Firmenich, Givaudan, etc.), or combinations of such fragrances, may also suitably be used in the detergent compositions and methods disclosed herein.

In one embodiment, the fragrance component is in the form of unencapsulated fragrance particles.

At least some of the fragrance can be encapsulated in a microcapsule. Examples of of encapsulated fragrances are provided in, for example, U.S. Pat. No. 6,458,754 and in U.S. Patent Application Publication No. 2011/0224127 A1. The contents of U.S. Pat. No. 6,056,949 and U.S. Patent Application Publication No. 2011/0224127 A1 are incorporated by reference in their entirety.

In one embodiment, all of the fragrance can be encapsulated in microcapsules.

The microcapsules can be water-soluble or water-insoluble.

Anti-Redeposition Polymers

Anti-redeposition polymers are typically polycarboxylate materials. Polycarboxylate materials, which can be prepared by polymerizing or copolymerizing suitable unsaturated monomers, are admixed in their acid form. Unsaturated monomeric acids that can be polymerized to form suitable polycarboxylates include acrylic acid, maleic acid (or maleic anhydride), fumaric acid, itaconic acid, aconitic acid, mesaconic acid, citraconic acid and methylenemalonic acid. The presence in the polycarboxylates herein of monomeric segments, containing no carboxylate radicals such as vinylmethyl ether, styrene, ethylene, etc. is suitable provided that such segments do not constitute more than about 40% by weight of the polymer.

Particularly suitable polycarboxylates can be derived from acrylic acid. Such acrylic acid-based polymers which are useful herein are the water-soluble salts of polymerised acrylic acid. The average molecular weight of such polymers in the acid form ranges from about 2,000 to 10,000, from about 4,000 to 7,000, or from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967. In one embodiment of the present invention, the polycarboxylate is sodium polyacrylate.

Acrylic/maleic-based copolymers may also be used as a component of the anti-redeposition agent. Such materials include the water-soluble salts of copolymers of acrylic acid and maleic acid. The average molecular weight of such copolymers in the acid form ranges from about 2,000 to 100,000, from about 5,000 to 75,000, or from about 7,000 to 65,000. The ratio of acrylate to maleate segments in such copolymers will generally range from about 30:1 to about 1:1, or from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful polymers maleic/acrylic/vinyl alcohol terpolymers. Such materials are also disclosed in EP 193,360, including, for example, the 45/43/10 terpolymer of acrylic/maleic/vinyl alcohol.

Polyethylene glycol (PEG) can act as a clay soil removal-antiredeposition agent. Typical molecular weight ranges for these purposes range from about 500 to about, 100,000, from about 1,000 to about 50,000, from about 3,000 to about 10,000. Polyaspartate and polyglutamate dispersing agents may also be used.

Any polymeric soil release agent known to those skilled in the art can optionally be employed in compositions according to the invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The amount of anti redeposition polymer in the composition according to the present invention will be from 0.01 to 10%, from 0.02 to 8%, or from 0.03 to 6%, by weight of the composition.

Other Ingredients

Other ingredients that can be included in the liquid detergent composition are known to a person of ordinary skill in the art and include pH adjusting agents, pearlescers or opacifiers, viscosity modifiers, preservatives, and natural hair nutrients such as botanicals, fruit extracts, sugar derivatives and amino acids.

EXAMPLES

Example 1

Preparation of Parenchymal Cellulose Composition containing Particulate Cellulose Material Fresh sugar beet pulp obtained from Suikerunie Dinteloord (NL) was washed in a flotation washer in order to remove sand, pebbles, etc.

In a stirred tank (working volume 70 L) heated with steam), 16.7 kg of washed sugar beet pulp having a solids content of 15% DS (2.5 kg DS in the batch) was introduced and tap water was added to a total volume of 70 L. The mass was heated with steam and, once the temperature reached 50° C., 1200 gram NaOH is added. Heating was continued to reach a final temperature of 95° C. After 45 minutes at 95° C., the mixture was subjected to low shear for 30 minutes (using a Silverson BX with a slitted screen). After a total period of 3 hours at 95° C., low shear was applied again for 60 minutes (using the Silverson BX with an emulsor screen with appertures of 1.5 mm), during which the temperature was kept at approximately 95° C.

Reduction of the particles was done with a Gaulin high pressure homogenizer, operating at 150 bar (first stage; second stage was 0 bar). The mixture was homogenized 6 times. This step was performed at ambient temperature. The mixture had been allowed to cool to ambient temperature before being subjected to the high pressure homogenization treatment.

The homogenized mass was subsequently introduced in a mixing tank and heated to a temperature of 80-85° C., where after a microfiltration step was performed using a ceramic membrane with a pore size of 1.4 μm. The permeate was replaced with demineralized water. As soon as the conductivity of the retentate reached 1 mS/cm, microfiltration was discontinued. The dry solids content was between 0.5 and 1%.

This end-product was subsequently concentrated in a filter bag having pores of 100 μm to reach a dry solids content of 2%.

The material was analyzed using a Malvern Mastersizer, confirming a median (volume-weighted) major dimension of the particles contained within the material of 43.65 μm, with approximately 90% of the material (on the basis of volume) having a particle size of below 100 μm.

Example 2

Preparation of Parenchymal Cellulose Composition Containing Particulate Cellulose Material Fresh sugar beet pulp (320 kg, 24.1% ds) obtained from Suikerunie Dinteloord (NL) was washed in a flotation washer in order to remove sand, pebbles, etc.

The washed sugar beet pulp was transferred to a stirred tank (1000 L) and diluted to a concentration of 8% (800 kg). Multifect pectinase FE (Genencor, 139 units/g ds) was added and the suspension was heated to 45° C. After 48 h the suspension was pressed using a membrane filter press (TEFSA) and the resulting solid material containing the cellulose material was isolated (216 kg 12% ds).

A portion of the resulting cellulose material (20 kg) was introduced in a stirred tank (working volume 70 L) and tap water was added to a total volume of 70 L. The mixture was heated to 95° C. and subjected to low shear for a total period of 3 hours at 95° C. (using a Silverson BX with a slitted screen. Then, low shear was applied for a further 60 minutes (using the Silverson BX with an emulsor screen with appertures of 1.5 mm), during which the temperature was kept at approximately 95° C.

Reduction of the particles was done with a Gaulin high pressure homogenizer, operating at 150 bar (first stage; second stage was 0 bar). The mixture was homogenized 6 times. This step was performed at ambient temperature. The mixture had been allowed to cool to ambient temperature before being subjected to the high pressure homogenization treatment.

The homogenized mass was subsequently introduced in a mixing tank and heated to a temperature of 80-85° C., where after a microfiltration step was performed using a ceramic membrane with a pore size of 1.4 μm. The permeate was replaced with demineralized water. As soon as the conductivity of the retentate reached 1 mS/cm, microfiltration was discontinued. The dry solids content was between 0,5 and 1%.

This end-product was subsequently concentrated in a filter bag having pores of 100 μm to reach a dry solids content of 2%.

The material was analyzed using a Malvern Mastersizer, confirming a median (volume-weighted) major dimension of the particles contained within the material of 51.03 μm, with approximately 90% of the material (on the basis of volume) having a particle size of below 100 μm.

Example 3

Preparation of 'MCF'

A new batch of particulate cellulose material of this invention was produced following the protocol of example 1, except that ensilaged beet pulp was used instead of fresh beet pulp. This time the end-product was concentrated to 5% dry matter content. This product is denominated 'MCF.'

Example 4

Preparation of Parenchymal Cellulose Composition Containing Particulate Cellulose Material 132 kg of ensilaged sugar beet pulp is washed in a flotation washing machine to remove all non sugar beet pulp items (sand, stones, wood, plastic, etc.). After washing, the sugar beet pulp is diluted with the same volume of water (132 kg) and heated up to 40° C. under continues slow mixing. At this temperature NaOH pellets are added to reach a molarity of 0.5M (5.3 kg NaOH pellets). Then the temperature is increased to 95° C. The silverson FX is switched on and the mixture is sheared during the complete reaction time of 60 minutes to reach a smooth texture. Then the mixture is cooled down to 80° C. and pumped into an chamber filter press to remove most of the water including a part of the proteins, hemicellulose and pectins. The filtrate is pumped to the sewage and the pressed cake is diluted with water of ambient temperature to a dry matter concentration around 1-2%. Then to this suspension sulfuric acid is added to reach a pH below 2 (about 8 liters of 25% sulfuric acid). After acidifying, the material is mixed with the Silverson FX during 15 minutes. After complete mixing the suspension is pumped to a high pressure Gaulin Homogeniser. The homogenizer is set on 150 bar (one stage) and the material is run through the homogenizer until a particle size (D[4,3]) of approximately 65 μm is reached. Then the suspension is pumped to the Chamber filter press. In the press the material is pressed to a dry matter content of 25%. The pressed cakes are then grinded into powder-like material and, which is packaged in an air-tight package.

Example 5

Effect of Bleaching on Visual Appearance and Viscosity Profile

An amount of MCF according to example 4 was subjected to treatment with sodium silicate, diethylene triamine pentaacetic acid (DTPA) and $H_2O_2$ (pH adjustment with NaOH and H2SO-4), which resulted (after washing) in a product with improved visual appearance. Applying a bleaching step to improve the visual appearance of the structuring agent of the invention does not substantially change the profile of shear rate vs. viscosity.

Example 6

Preparation of Liquid Detergent Compositions

A dispersion of the structuring agent is dispersed in water at the specified concentration to form an aqueous suspension. The aqueous suspension is homogenized with sufficient amount to water to provide a substantially uniform aqueous suspension. The surfactant and builder are mixed into the substantially uniform aqueous suspension. The resulting mixture is homogenized for 2-10 minutes at 2500 rpm to 10,000 rpm to yield a second aqueous suspension. Optional ingredients, such as, preservative, fragrance, dyes, are mixed into the second aqueous suspension to yield the detergent composition.

Using the method described above, the following formulations were prepared:

| | Active % | | | | | |
|---|---|---|---|---|---|---|
| Component | A | B | C | D | E | F |
| Water | QS | QS | QS | QS | QS | QS |
| Structurants according to Examples 4 or 5 | 0.30 | 0.25 | 0.08-0.50 | 0.05-0.30 | 0.05-0.30 | 0.05-0.30 |
| Citric Acid | 1.75 | | 3.25 | | 3.8 | 3.5 |
| Sodium Hydroxide | 2.53 | 0.54 | 2.23 | 0.576 | 2.6 | 2.5 |
| Tri-ethanolamine | 2.55 | | 0.6 | | 1.5 | 1 |
| Aklylbenzene Sulfonic Acid | 10.2 | 3.6 | 2 | 4.0 | 3.0 | 3.35 |
| Coconut Fatty Acid | 1.2 | 0.2 | 0.5 | | 1.8 | 1.0 |
| MES | | | 2.0 | | 3.5 | 1 |
| SLES | 6.8 | 6.0 | 4.0 | 8.0 | 8.5 | 9 |
| Alcohol Ethoxylate | 17 | 2.4 | 5.4 | 1.64 | 13 | 12 |
| F-dye | 0.30 | 0.1 | 0.1-0.2 | 0.20 | 0.1 | 0.1 |
| Sodium Bicarbonate | | 0.1 | | | | |
| Sodium Carbonate | | 2.0 | | 2.0 | | |
| Acusol 445N | | 0.25 | | | 0.30 | |
| HP 20 | | | 1.0 | | 1 | |
| Alcosperse 726 | | | | | | 0.2 |
| Calcium Chloride | | | 0.05 | | | |
| Imino-disuccinic Acid | | | 0.20 | | 0.1 | 0.1 |

-continued

| | Active % | | | | | |
|---|---|---|---|---|---|---|
| Component | A | B | C | D | E | F |
| Enzymes | | | as required | | as required | as required |
| Preservative | as required | as required | as required | as required | as required | as required |
| Color | as required | as required | as required | as required | as required | as required |
| Fragrance | as required | as required | as required | as required | as required | as required |

Example 7

Preparation of Fragrance Slurry

A dispersion of the structuring agent is dispersed in water at the specified concentration to form an aqueous suspension. The aqueous suspension is homogenized with sufficient amount to water to provide a substantially uniform aqueous suspension. The fragrance component is added into the uniform aqueous suspension and mixed to form the following fragrance compositions.

| Component | Active % | | |
|---|---|---|---|
| Water | QS | QS | QS |
| Structurants according to examples 4 or 5 | 0.05 | 0.10 | 0.3 |
| Encapsulated Fragrance Slurry | 50% | 50% | 25% |
| Preservative | As required | As required | As required |

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The breadth and scope of the present invention should not be limited by any of the above-described exemplary embodiments, but should be defined only in accordance with the following claims and their equivalents.

What is claimed is:

1. A liquid detergent composition comprising:

(a) an aqueous medium;

(b) about 5 wt % to about 45 wt % of a surfactant system, wherein the surfactant system comprises:

(i) about 15 to about 20 wt % of an anionic surfactant selected from the group consisting of methyl ester sulfonate, sodium lauryl ether sulphate, and mixtures thereof, and about 15 to about 20 wt % of an alcohol ethoxylate;

(ii) about 8 to about 12 wt % of an anionic surfactant selected from the group consisting of methyl ester sulfonate, sodium lauryl ether sulphate, and mixtures thereof, and about 1 to about 5 wt % of an alcohol ethoxylate;

(iii) about 5 to about 10 wt % of an anionic surfactant selected from the group consisting of methyl ester sulfonate, sodium lauryl ether sulphate, and mixtures thereof, and about 4 to about 6 wt % of an alcohol ethoxylate; or (iv) about 10 to about 15 wt % of an anionic surfactant selected from the group consisting of methyl ester sulfonate, sodium lauryl ether sulphate, and mixtures thereof, and about 1 to about 15 wt % of an alcohol ethoxylate;

(c) about 0.1 wt % to about 10 wt % of a builder component;

(d) about 0.01 wt % to about 1 wt % of an external structuring agent, comprising particulate cellulose material containing, by dry weight, at least 60% cellulose, 0.5-10% pectin and 1-15% hemicellulose, and has a volume-weighted median particle dimension within the range of 25-75 μm, as measured by laser light diffractometry.

2. The liquid detergent composition according to claim 1, wherein the methyl ester sulfonate has the following formula (I):

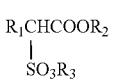

(I)

wherein $R_1$ is a $C_4$ to $C_{24}$ alkane, $R_2$ is methyl, and $R_3$ is a mono-valent or di-valent cation.

3. The liquid detergent composition according to claim 1, wherein the builder component is selected from the group consisting of an organic acid, an alkali metal hydroxide, an amine, and mixtures thereof.

4. The liquid detergent composition according to claim 3, wherein the builder component is selected from the group consisting of citric acid, sodium carbonate, sodium bicarbonate, sodium hydroxide, calcium chloride, triethanolamine, monoethanolamine, and mixtures thereof, in an amount from about 1% to about 8%.

5. The liquid detergent composition according to claim 1, further comprising a chelator.

6. The liquid detergent composition according to claim 5, wherein the chelator is a polycarboxylic acid.

7. The liquid detergent composition according to claim 6, wherein the polycarboxylic acid is ethylenediaminetetraacetic acid, succinic acid, iminodisuccinic acid, salts thereof, or mixtures thereof.

8. The liquid detergent composition according to claim 1, further comprising at least one additional component selected from the group consisting of a defoamer, an enzyme, a color component, a fragrance component, and mixtures thereof.

9. The liquid detergent composition according to claim 1, further comprising a fragrance component.

10. The liquid detergent composition of claim 9, wherein the fragrance component is encapsulated.

11. A fragrance composition, comprising:

(g) an aqueous medium;

(h) about 10 wt % to about 75 wt % of a an encapsulated fragrance component; and (i) about 0.01 wt % to about 1 wt % of an external structuring agent, comprising particulate cellulose material containing, by dry weight, at least 60% cellulose, 0.5-10% pectin and 1-15% hemicellulose, and has a volume-weighted median particle dimension within the range of 25-75 μm, as measured by laser light diffractometry.

12. The fragrance composition according to claim 11, comprising about 25 wt % of the fragrance component.

13. The fragrance composition according to claim 11, comprising about 50 wt % of the fragrance component.

14. The liquid detergent composition according to claim 1, wherein the anionic surfactant comprises a mixture of methyl ester sulfonate and sodium lauryl ether sulphate.

* * * * *